US006112756A

United States Patent [19]

Tseng

[11] Patent Number: 6,112,756

[45] Date of Patent: Sep. 5, 2000

[54] COVERING FRAME

[75] Inventor: Chuen-Jong Tseng, Chiayi Hsien, Taiwan

[73] Assignee: Shin Yen Enterprise Co., Ltd., Chiayi Hsien, Taiwan

[21] Appl. No.: 09/209,613

[22] Filed: Dec. 11, 1998

[51] Int. Cl.[7] ..... E04H 15/00; E04H 15/32

[52] U.S. Cl. ..... 135/123; 52/223.1; 135/124

[58] Field of Search ..... 135/123, 124; 52/223.1, 223.14

[56] References Cited

U.S. PATENT DOCUMENTS

| | | |
|---|---|---|
| 1,709,568 | 4/1929 | Frank . |
| 1,721,198 | 7/1929 | Athey . |
| 2,000,644 | 5/1935 | Powers . |
| 2,677,384 | 5/1954 | Luisafa . |
| 3,961,442 | 6/1976 | Carter . |
| 4,121,604 | 10/1978 | Rain . |
| 4,860,504 | 8/1989 | Lawrence . |
| 5,595,203 | 1/1997 | Espinosa . |
| 5,930,971 | 8/1999 | Etheridge . |

*Primary Examiner*—Robert Canfield
*Attorney, Agent, or Firm*—Ladas & Parry

[57] ABSTRACT

A covering frame for supporting a canopy above a ground surface includes a plurality of legs adapted to extend uprightly from the ground surface, and a canopy support frame mounted on top of the legs. The canopy support frame includes at least one pair of parallel support rods having lower ends mounted on the legs and upper ends, an upper horizontal bar interconnecting the upper ends of the support rods, a lower horizontal bar parallel to the upper horizontal bar and interconnecting the lower ends of the support rods, and a supplementary canopy support member extending transversely between the support rods. The supplementary canopy support member includes a seat having two opposite mounting ends, and a pair of connecting wires having outer ends connected respectively to the support rods and inner ends mounted adjustably and respectively on the mounting ends of the seat. The seat is operable to result in lengthening and shortening of a distance between the outer ends of the connecting wires, thereby permitting adjustment of the distance between the outer ends of the connecting wires to be equal to a distance between the support rods.

3 Claims, 5 Drawing Sheets

COVERING FRAME

BACKGROUND OF THE INVENTION

1. Field of the Invention

This invention relates to a covering frame for supporting a canopy above a ground surface, more particularly to a covering frame which includes a supplementary canopy support member to help support the canopy.

2. Description of the Related Art

FIG. 1 illustrates a conventional canopy support frame 11 which includes a leg frame 111 and a canopy support frame 112. A canopy 12 is spread and supported on the canopy support frame 112 to provide a shade from sunlight, rain or snow. As shown, the canopy 12 has a region (a) which is not directly supported by canopy support frame 112. As such, when the covering frame 11 is used under heavy rain or snow, the rain or snow is likely to accumulate on the canopy 12 at the region (a), thereby resulting in sinking of the canopy 12 at the region (a). The weight of the rain or snow that accumulated on the canopy 12 at the region (a) might result in breakage of the canopy 12. Even though the canopy 12 may be relatively stiff, the load applied to the leg frame 111 by the weight of the accumulated rain or snow will likely result in collapsing of the entire covering frame 11 due to insufficient strength of the leg frame 111.

SUMMARY OF THE INVENTION

Therefore, the object of the present invention is to provide a covering frame which includes a supplementary canopy support member to help support the canopy.

Accordingly, the covering frame of the present invention is adapted for supporting a canopy above a ground surface, and includes a plurality of legs adapted to extend uprightly from the ground surface, and a canopy support frame mounted on top of the legs. The canopy support frame includes at least one pair of parallel support rods having lower ends mounted on the legs and upper ends, an upper horizontal bar interconnecting the upper ends of the support rods, a lower horizontal bar parallel to the upper horizontal bar and interconnecting the lower ends of the support rods, and a supplementary canopy support member extending transversely between the support rods. The supplementary canopy support member includes a seat having two opposite mounting ends, and a pair of connecting wires having outer ends connected respectively to the support rods and inner ends mounted adjustably and respectively on the mounting ends of the seat. The seat is operable to result in lengthening and shortening of a distance between the outer ends of the connecting wires, thereby permitting adjustment of the distance between the outer ends of the connecting wires to be equal to a distance between the support rods.

BRIEF DESCRIPTION OF THE DRAWINGS

Other features and advantages of the present invention will become apparent in the following detailed description of the preferred embodiment with reference to the accompanying drawings, in which.

DETAILED DESCRIPTION OF THE PREFERRED EMBODIMENT

Figure 1:
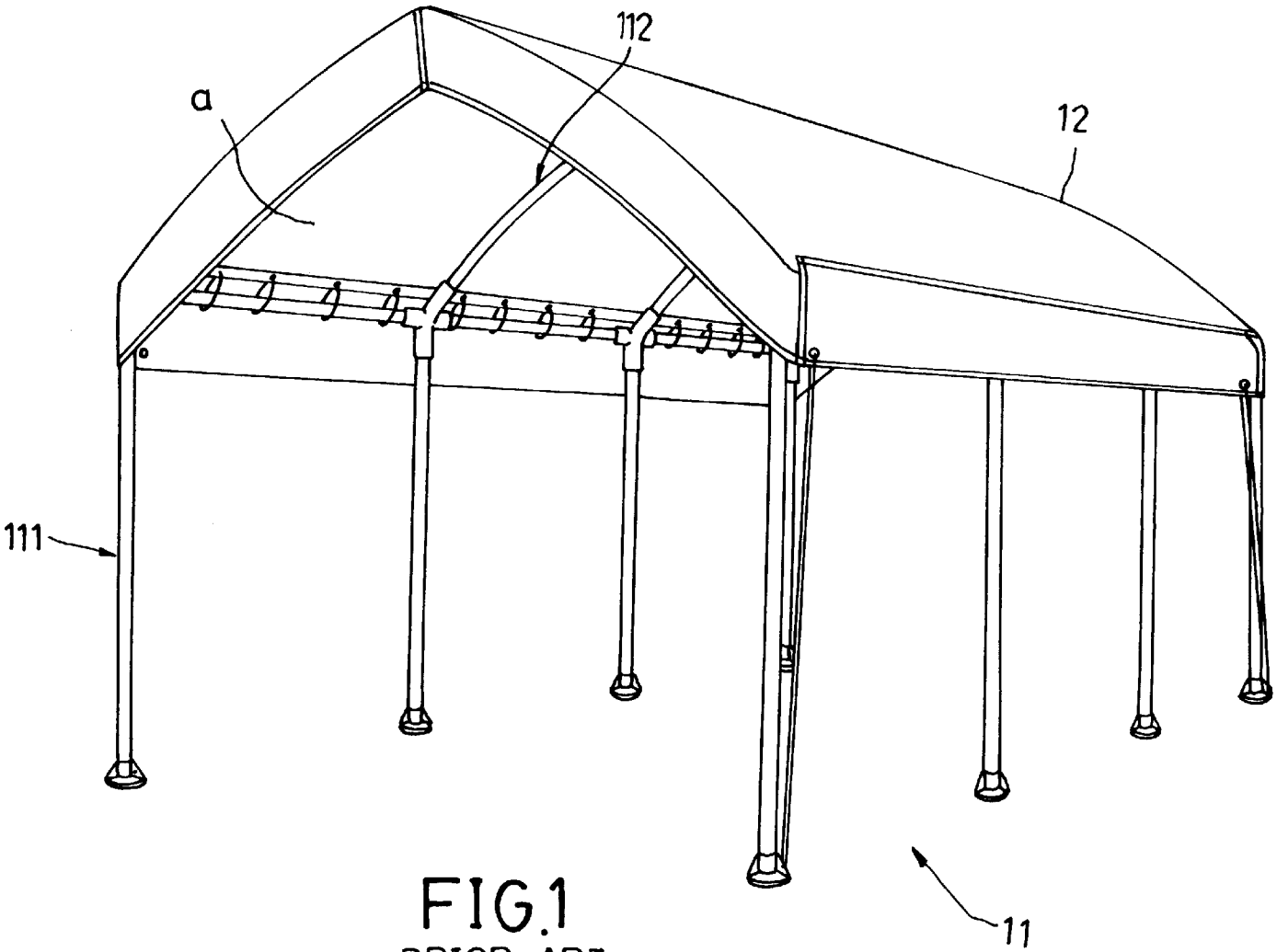
FIG.1 PRIOR ART
FIG. 1 is a perspective view of a conventional covering frame for supporting a canopy.
Figure 2:
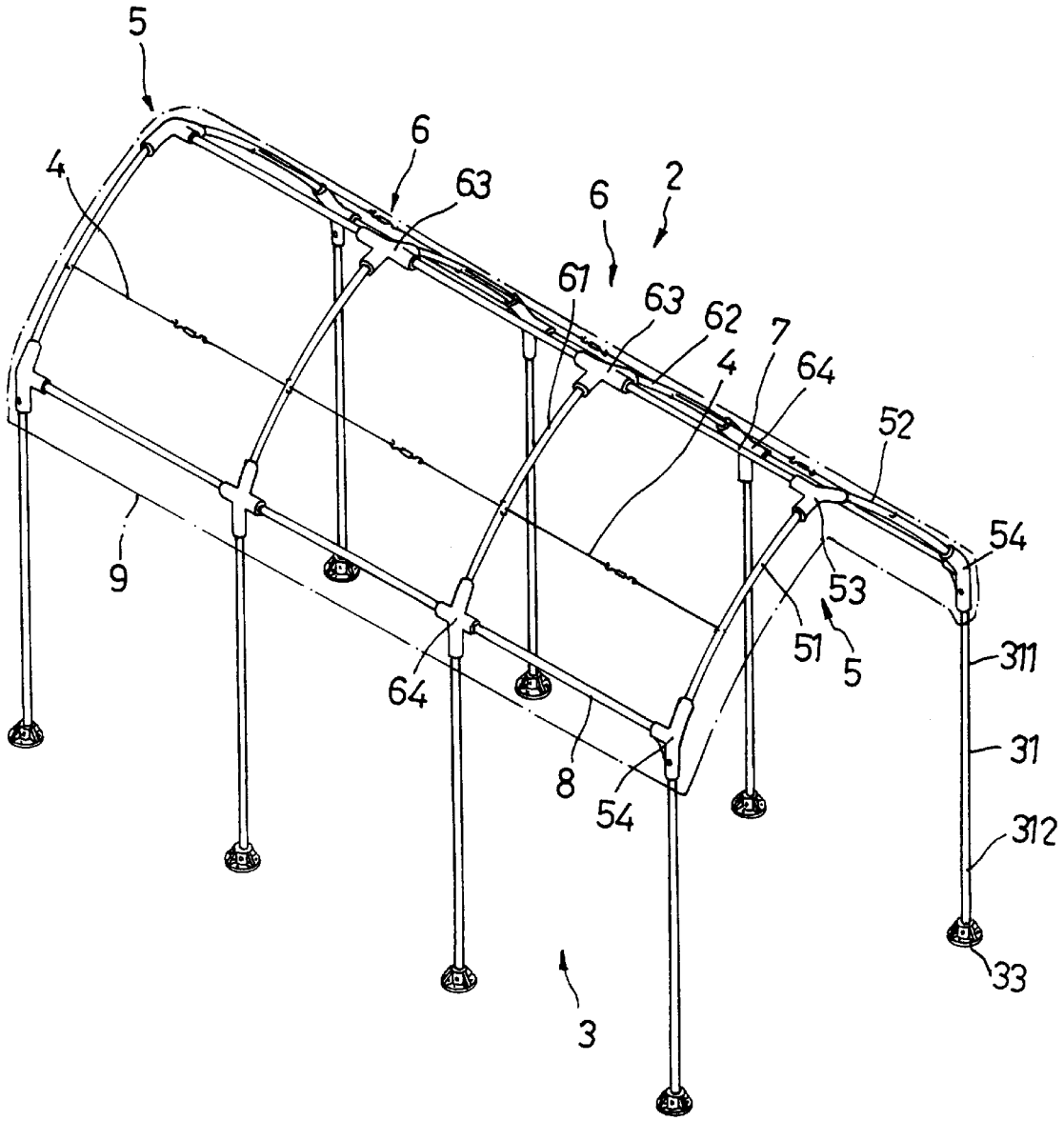
FIG. 2 is a perspective view of a preferred embodiment of the covering frame of the present invention.
Figure 3:
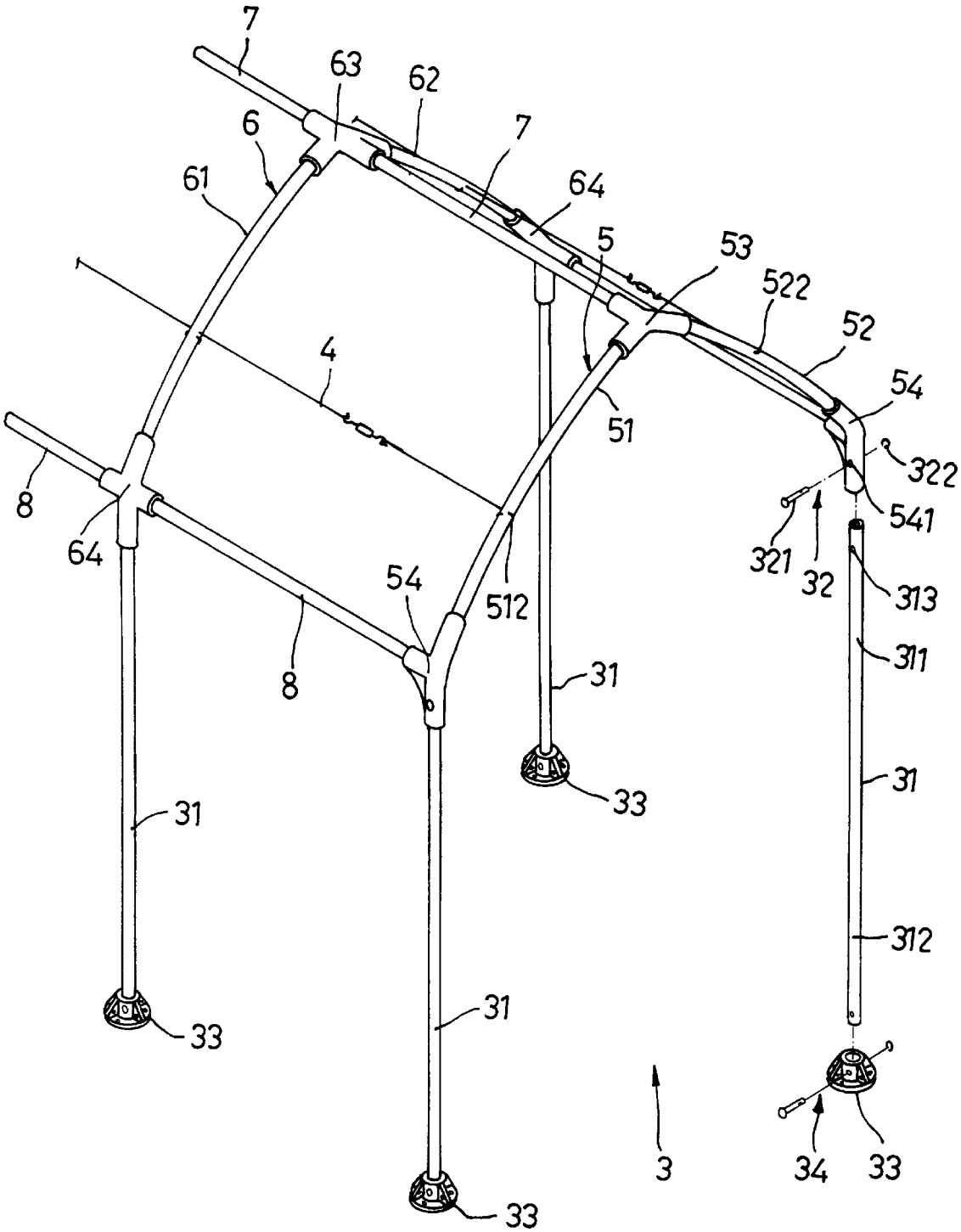
FIG. 3 is a partly exploded, fragmentary perspective view of the covering frame of the preferred embodiment.

Referring to FIGS. 2 and 3, the preferred embodiment of the covering frame of the present invention is shown to include a leg frame 3 and a canopy support frame 2 mounted on top of the leg frame 3 for supporting a canopy 9 (shown in phantom lines) above a ground surface. The leg frame 3 includes a plurality of pairs of legs 31, a plurality of pairs of base members 33, and two pairs of fastener units 32.

The canopy support frame 2 includes a pair of outer frame units 5, two inner frame units 6 disposed between the outer frame units 5, three upper horizontal bars 7, and three pairs of lower horizontal bars 8.

Each of the outer frame units 5 includes a left support rod 51, a right support rod 52, a three-way first connector 53, and a pair of three-way second connectors 54. Each of the first and second connectors 53, 54 has three tubular connecting portions. Each of the left and right support rods 51, 52 is slightly curved, and has an intermediate section formed with a through hole 512, 522. The first connector 53 permits upper ends of the left and right support rods 51, 52 to extend into the corresponding tubular connecting portions thereof in order to interconnect the same. The second connectors 54 permit lower ends of the left and right support rods 51, 52 and upper ends 311 of a respective pair of the legs 31 to extend into the corresponding tubular connecting portions thereof in order to mount the lower ends of the left and right support rods 51, 52 on the upper ends 311 of the respective pair of the legs 31.

The fastener units 32 are provided at four corners of the covering frame for fastening the pair of outer frame units 5 to the respective pairs of legs 31. Each of the fastener units 32 includes a pin 321 that extends through a radial pin hole 541 formed in a downwardly extending tubular connecting portion of a respective one of the second connectors 54, and through a radial pin hole 313 formed in the upper end 311 of a respective one of the legs 31, and a fastening ring 322 engaging a distal end of the pin 321 for retaining the pin 321 in the pin holes 541, 313.

Figure 4:
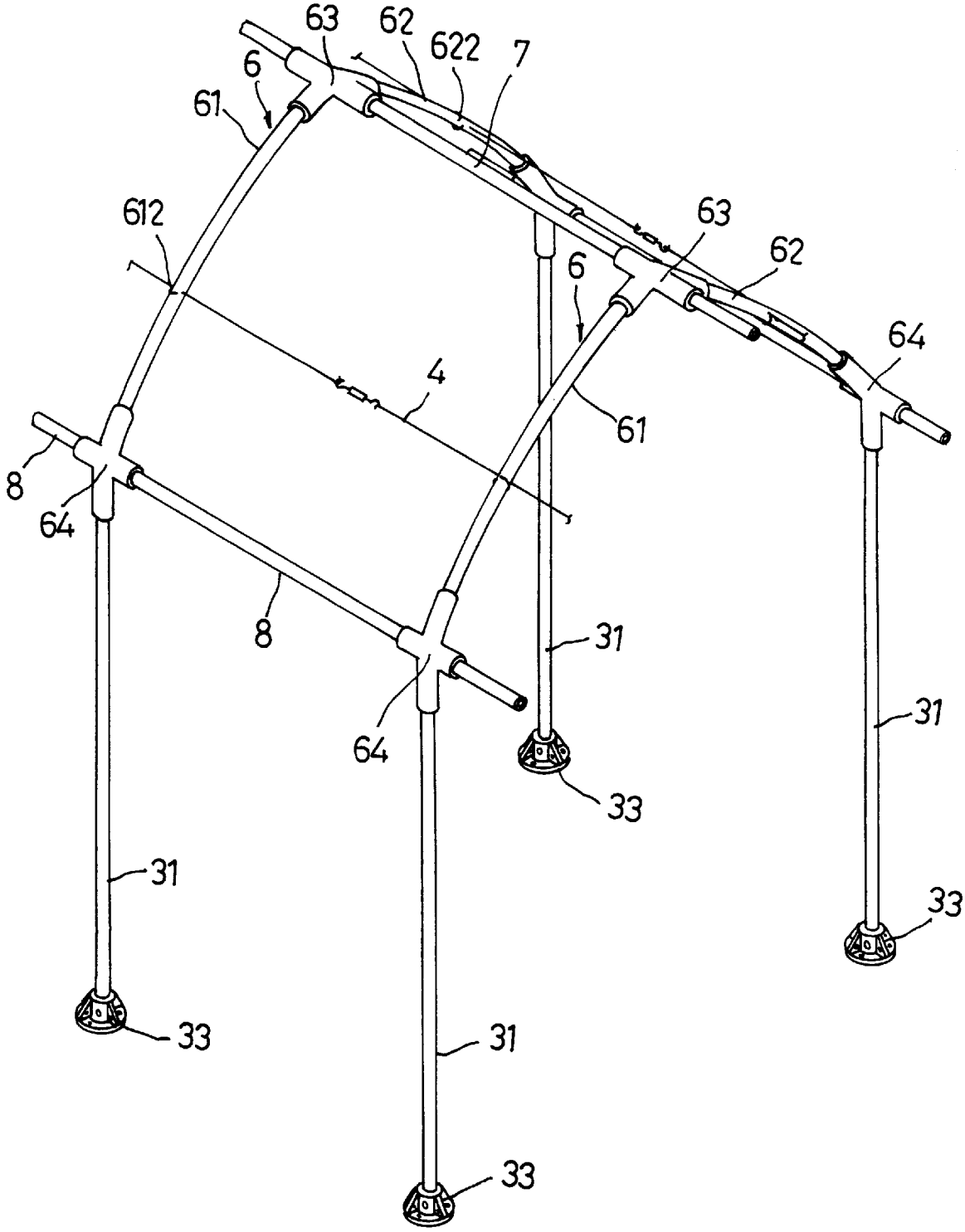
FIG. 4 is another fragmentary perspective view of the covering frame of the preferred embodiment.

Referring to FIGS. 2 and 4, each of the inner frame units 6 includes a left support rod 61, a right support rod 62, a four-way third connector 63, and a pair of four-way fourth connectors 64. Each of the third and fourth connectors 63, 64 has four tubular connecting portions. Each of the left and right support rods 61, 62 is slightly curved, and has an intermediate section formed with a through hole 612, 622. The third connector 63 permits upper ends of the left and right support rods 61, 62 to extend into the corresponding tubular connecting portions thereof in order to interconnect the same. The fourth connectors 64 permit lower ends of the left and right support rods 61, 62 and upper ends 311 of a respective pair of the legs 31 to extend into the corresponding tubular connecting portions thereof in order to mount the lower ends of the left and right support rods 61, 62 on the upper ends 311 of the respective pair of the legs 31.

Each of the upper horizontal bars 7 is transverse to the inner and outer frame units 6, 5, and has two opposite ends extending into the corresponding tubular connecting portions of an adjacent pair of the first and third connectors 53, 63. Each of the lower horizontal bars 8 is parallel to the upper horizontal bars 7, and has two opposite ends extending into the corresponding tubular connecting portions of an adjacent pair of the second and fourth connectors 54, 64.

Referring to FIG. 3, the base members 33 are adapted to be placed on the ground surface, and are respectively fastened to lower ends 312 of the legs 31 by means of fastener units 34 similar to the fastener units 32.

Figure 5:
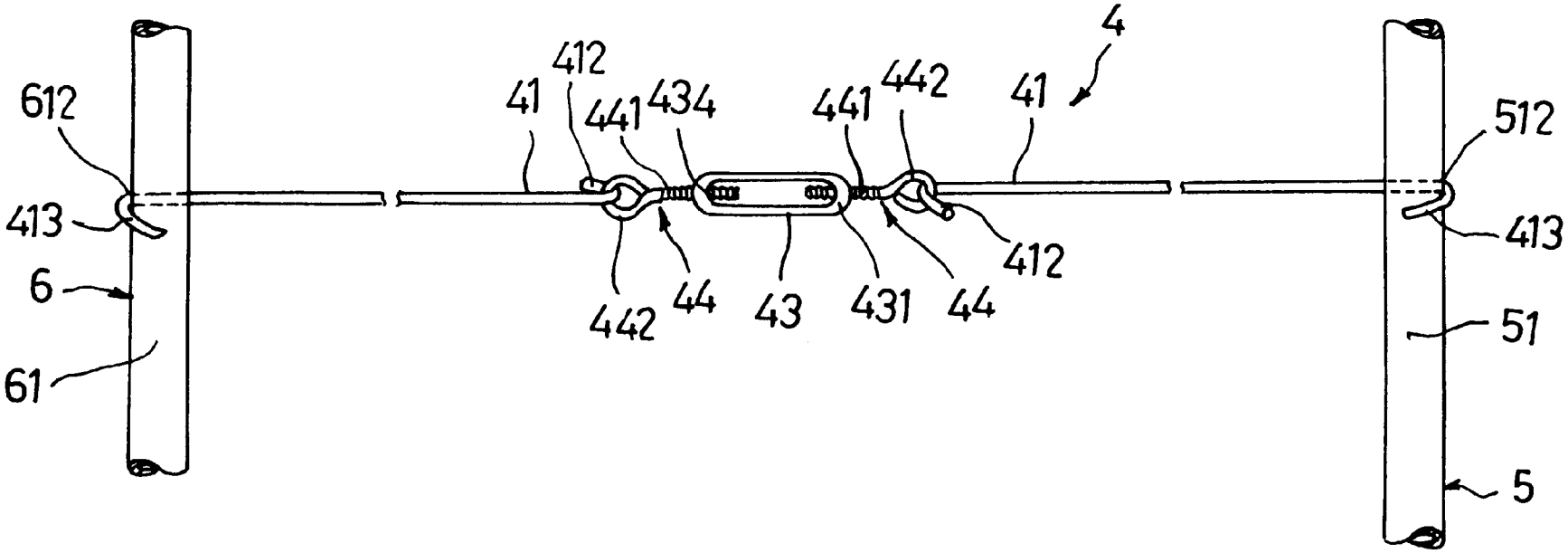
FIG. 5 is an enlarged fragmentary schematic view illustrating a supplementary canopy support member of the covering frame of the preferred embodiment.

Referring to FIGS. 2 and 5, each of the supplementary canopy support members 4 extends transversely between the left support rods 51, 61 (or right support rods 52, 62) of an adjacent pair of the outer and inner frame units 5, 6. Each of the supplementary canopy support members 4 includes a seat 43, a pair of connecting wires 41, and a pair of regulating members 44. FIG. 5 is illustrated in terms of the supplementary canopy support member 4 that extends between the left support rods 51, 61 of one of the outer frame units 5 and an adjacent one of the inner frame units 6.

The seat 43 has an elongated ring-shaped structure with two opposite mounting ends 431 formed with coaxial threaded holes 434, which have screw threads that extend in opposite directions. Each of the regulating members 44 has a threaded shank portion 441 extending threadedly through a respective one of the threaded holes 434, and a ring portion 442 connected to the threaded shank portion 441. Each of the connecting wires 41 has a hooked inner end 412 hooked at the ring portion 442 of a respective one of the regulating members 44, and a hooked outer end 413 extended through the through hole 512, 612 formed in a respective one of the support rods 51, 61 and hooked at the respective support rod 51, 61. Rotation of the seat 43 in a certain direction relative to the regulating members 44 about an axis of the threaded holes 434 results in simultaneous threading in of the threaded shank portions 441 of the regulating members 44 relative to the seat 43, thereby resulting in shortening of a distance between the outer ends 413 of the connecting wires 41. Rotation of the seat 43 in an opposite direction relative to the regulating members 44 about the axis of the threaded holes 434 results in simultaneous threading out of the threaded shank portions 441 of the regulating members 44 relative to the seat 43, thereby resulting lengthening of the distance between the outer ends 413 of the connecting wires 41. Therefore, by operating the seat 43, the distance between the outer ends 413 of the connecting wires 41 can be adjusted to be equal to a distance between the support rods 51, 61 of the adjacent pair of the outer and inner frame units 5, 6.

With the provision of the supplementary canopy support members 4, the canopy can be prevented from sinking in a manner similar to that occurring in the conventional covering frame. The supplementary canopy support members 4 can further prevent accumulation of rain or snow on the canopy to prevent the application of an undesired load on the leg frame 3 that might result in the collapse of the entire covering frame.

With this invention thus explained, it is apparent that numerous modifications and variations can be made without departing from the scope and spirit of this invention. It is therefore intended that this invention be limited only as indicated in the appended claims.

I claim:

1. A covering frame for supporting a canopy above a ground surface, comprising:

a plurality of legs adapted to extend uprightly from the ground surface; and a canopy support frame mounted on top of said legs, said canopy support frame including at least one pair of parallel support rods having lower ends mounted on said legs and upper ends, an upper horizontal bar interconnecting said upper ends of said support rods, a lower horizontal bar parallel to said upper horizontal bar and interconnecting said lower ends of said support rods, and a supplementary canopy support member extending transversely between said support rods, said supplementary canopy support member including:

a seat having two opposite mounting ends; and a pair of connecting wires having outer ends connected respectively to said support rods and inner ends mounted adjustably and respectively on said mounting ends of said seat;

said seat being operable to result in lengthening and shortening of a distance between said outer ends of said connecting wires, thereby permitting adjustment of the distance between said outer ends of said connecting wires to be equal to a distance between said support rods.

2. The covering frame according to claim 1, wherein said seat is formed with two coaxial threaded holes in said mounting ends, said supplementary canopy support member further including a pair of regulating members, each of which has a threaded shank portion extending threadedly through said threaded hole in a respective one of said mounting ends, and a ring portion, said inner end of each of said connecting wires being formed with a hook for hooking at said ring portion of a respective one of said regulating members, said seat being rotatable relative to said connecting wires about an axis of said threaded holes to result in threading in and threading out of said threaded shank portions of said regulating members in said threaded holes to permit adjustment of the distance between said outer ends of said connecting wires.

3. The covering frame according to claim 1, wherein each of said support rods of said canopy support frame is formed with a through hole, said outer end of each of said connecting wires is formed with a hook that is extended through said through hole in the respective one of said support rods and that is hooked at the respective one of said support rods.

* * * * *